US009875863B2

(12) United States Patent
Hsiao

(10) Patent No.: US 9,875,863 B2
(45) Date of Patent: Jan. 23, 2018

(54) KEY STRUCTURE FACILITATING KEY CAP REMOVAL

(71) Applicant: ASUSTeK COMPUTER INC., Taipei (TW)

(72) Inventor: Li-Sheng Hsiao, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/293,471

(22) Filed: Oct. 14, 2016

(65) Prior Publication Data

US 2017/0125187 A1 May 4, 2017

Related U.S. Application Data

(60) Provisional application No. 62/249,356, filed on Nov. 2, 2015.

(30) Foreign Application Priority Data

Jul. 18, 2016 (TW) ..... 105122654

(51) Int. Cl.
*H01H 13/70* (2006.01)
*H01H 13/14* (2006.01)

(52) U.S. Cl.
CPC ..... *H01H 13/14* (2013.01); *H01H 2209/074* (2013.01); *H01H 2221/068* (2013.01); *H01H 2231/002* (2013.01); *H01H 2235/00* (2013.01)

(58) Field of Classification Search
CPC .. H01H 13/14; H01H 13/705; H01H 13/7065; H01H 2233/07; H01H 2233/08; H01H 2221/066
(Continued)

(56) References Cited

U.S. PATENT DOCUMENTS 5,735,390 A * 4/1998 Takagi ..... H01H 3/125 200/341
5,767,464 A * 6/1998 Dyer ..... H01H 3/125 200/344
(Continued)

FOREIGN PATENT DOCUMENTS

CN 101996801 A 3/2011
TW 315959 U 9/1997
TW I428945 B 11/2012

*Primary Examiner* — Vanessa Girardi
(74) *Attorney, Agent, or Firm* — McClure, Qualey & Rodack, LLP

(57) ABSTRACT

A key structure is provided. The key structure comprises a substrate, a membrane circuit disposed on the substrate, a conduction switch disposed on the membrane circuit, a keycap, a bending portion fixed to the keycap, an elastic member disposed on the membrane circuit and abutting against the keycap, and a connecting rod disposed movably between the membrane circuit and the keycap. The connecting rod includes an operating arm and an engaging portion. The operating arm is connected to the engaging portion, and the engaging portion selectively engages with the bending portion. When the operating arm moves in a direction parallel to a surface of the keycap, the operating arm drives the engaging portion to disengage from the bending portion and the elastic member provides a force against the keycap to move the keycap away from the conduction switch.

10 Claims, 8 Drawing Sheets

(58) Field of Classification Search
USPC ..... 200/344, 345; 400/490, 492, 495
See application file for complete search history.

(56) References Cited

U.S. PATENT DOCUMENTS 5,793,605 A * 8/1998 Sellers ..... G06F 1/1616
200/344
7,034,718 B2 * 4/2006 Hsu ..... G06F 1/1616
200/344
8,653,389 B2 2/2014 Liang et al.

* cited by examiner

KEY STRUCTURE FACILITATING KEY CAP REMOVAL

CROSS-REFERENCE TO RELATED APPLICATION

This application claims the priority benefit of U.S. provisional application Ser. No. 62/249,356, filed on Nov. 2, 2015 and TW application serial No. 105122654, filed on Jul. 18, 2016. The entirety of the above-mentioned patent applications are hereby incorporated by references herein and made a part of specification.

BACKGROUND OF THE INVENTION

Field of the Invention

The invention relates to a key structure and, more specifically to, a detachable key structure.

Description of the Related Art

In a conventional keyboard configured to an electronic device (such as a tablet computer), an elastic conduction switch is disposed on a membrane circuit, and a keycap is disposed on the conduction switch. The conduction switch is triggered by pressing the keycap to enable a corresponding keying circuit of the membrane circuit, and thus a keying signal corresponding to the keystroke is sent out.

A scissors-type positioning structure is disposed between the membrane circuit and the keycap to allow the keycap to move up and down within a certain distance. When the keycap is removed for cleaning or replacing, the keycap needs to be pulled up manually or disengage from the scissors-type positioning structure via a special tool. However, the keycap is easily damaged due to a great force or a wrong way while removing.

BRIEF SUMMARY OF THE INVENTION

According to an aspect of the disclosure, a key structure comprises: a substrate; a membrane circuit disposed on the substrate; a conduction switch disposed on the membrane circuit; a keycap; a bending portion fixed to the keycap; an elastic member disposed on the membrane circuit and abutting against the keycap; and a connecting rod disposed movably between the membrane circuit and the keycap. The connecting rod includes an operating arm and an engaging portion, the operating arm is connected to the engaging portion, and the engaging portion selectively engages with the bending portion. When the operating arm moves in a direction parallel to a surface of the keycap, the operating arm drives the engaging portion to disengage from the bending portion and the elastic member provides a force against the keycap to move the keycap away from the conduction switch.

In sum, in embodiments, when a user wants to disassemble the keycap to clean the keycap or the inside portion of the keyboard, the user only needs to pull the operating arm to drive the engaging portion to disengage from the bending portion. After the disengagement of the keycap and the connecting rod, the compressed elastic member provides a force to move the keycap upward. The keycap is reassembled by pressing the keycap or moving the operating arm to engage the engaging portion of the connecting rod with the engaging arm.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1:
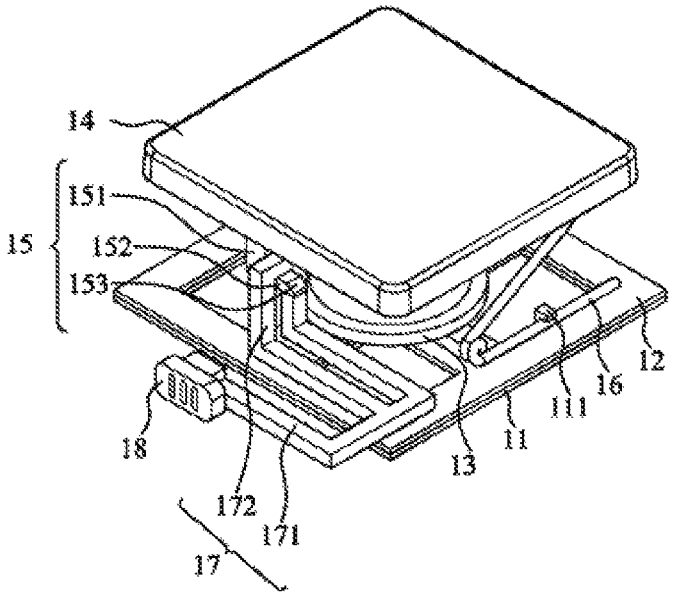
FIG. 1 is a schematic diagram showing a key structure in a first embodiment.
Figure 2:
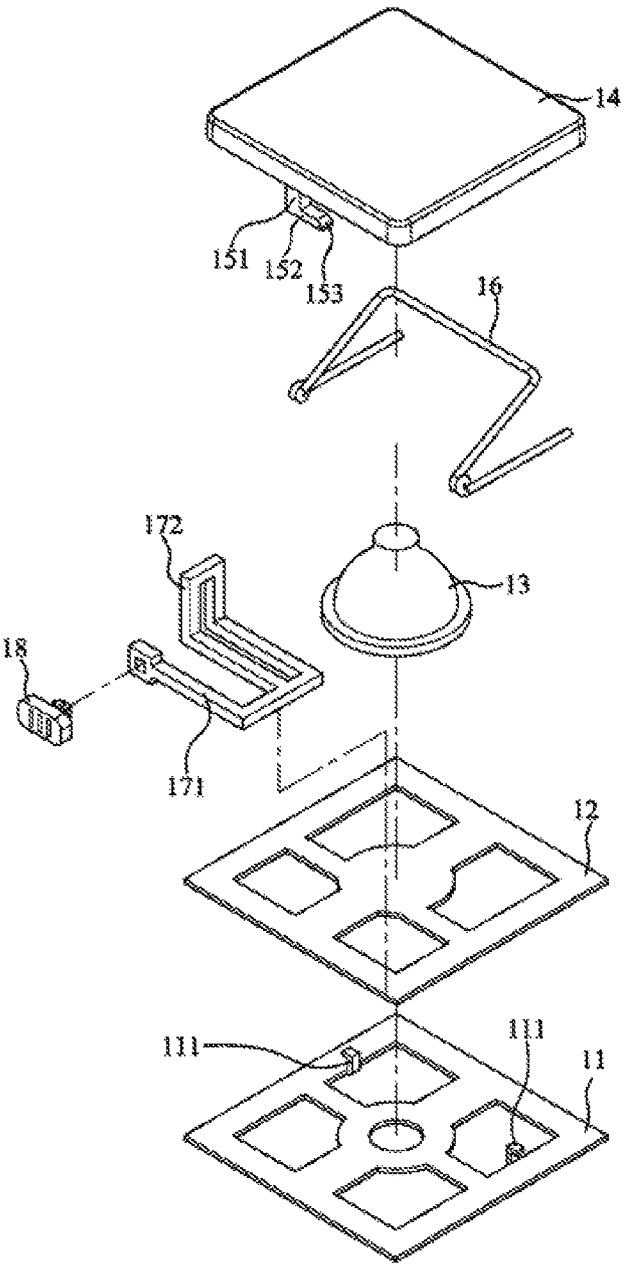
FIG. 2 is an exploded view of the key structure in the first embodiment.
Figure 3:
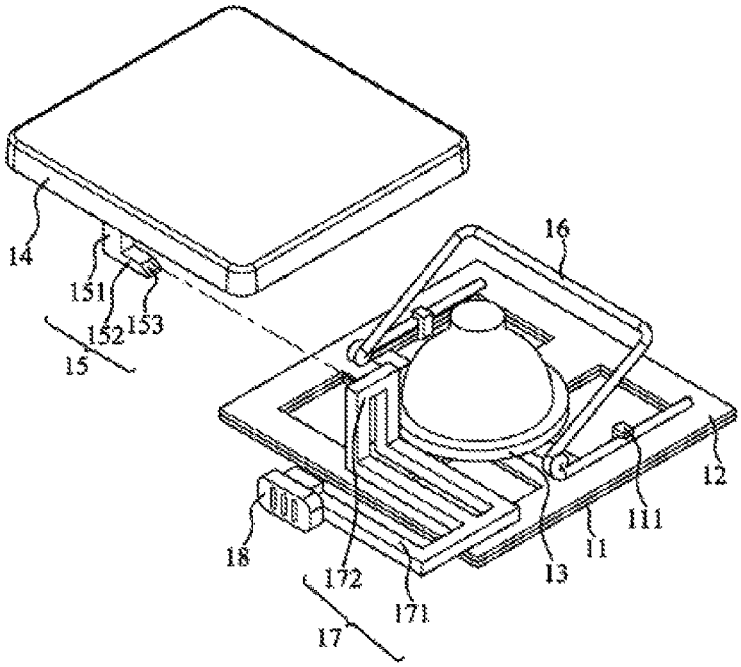
FIG. 3 is a schematic diagram showing the key structure in the first embodiment with the keycap removed.
Figure 4:
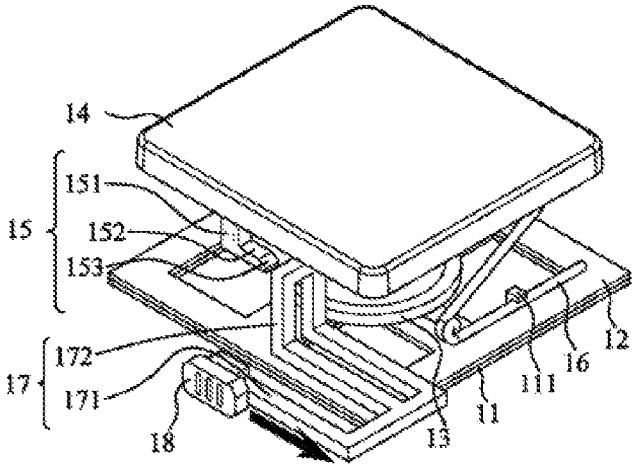
FIG. 4 is a schematic diagram showing the key structure in an operating state in the first embodiment.

Please refer to FIG. 1 to FIG. 4, FIG. 1 is a schematic diagram showing a key structure in a first embodiment, FIG. 2 is an exploded view of the key structure in the first embodiment, FIG. 3 is a schematic diagram showing the key structure in the first embodiment with the keycap removed, and FIG. 4 is a schematic diagram showing the key structure in an operating state in the first embodiment. In the embodiment, one key of a key structure is exemplified for description. However, the number of the key is not limited herein. For example, a plurality of keys are configured to the keyboard.

As shown in FIG. 2, in the embodiment, the key structure includes a substrate 11, a membrane circuit 12, a conduction switch 13, a keycap 14, a bending portion 15, an elastic member 16 and a connecting rod 17. As shown in FIG. 2 and FIG. 3, the membrane circuit 12 is configured on the substrate 11. The substrate 11 includes two positioning member 111 passing through the membrane circuit 12 to protrude out of the membrane circuit 12. The positioning member 111 is used for fixing the elastic member 16 on the membrane circuit 12. The positioning member 111 abuts against the keycap 14 after the keycap 14 is assembled. In the embodiment, the elastic member 16 is a compressed spring to provide a force to move the keycap 14 upward when the keycap 14 is disassembled. Details for the operation are described hereinafter.

The conduction switch 13 is configured on the membrane circuit 12. In an embodiment, the conduction switch 13 is first sticked to the membrane circuit 12 when assembled. The conduction switch 13 is pressed to conduct a control circuit of the membrane circuit 12. The connecting rod 17 is disposed on the membrane circuit 12 and close to the conduction switch 13. A bending portion 15 is fixed below the keycap 14. When the keycap 14 is pressed against the conduction switch 13 and the elastic member 16, the connecting rod 17 is driven to engage with the bending portion 15 to fix the keycap 14.

As shown in FIG. 2, the bending portion 15 includes a connecting arm 151 and an engaging arm 152. Two ends of the connecting arm 151 are connected to the keycap 14 and the engaging arm 152, respectively. An end of the engaging arm 152 that is not connected to the connecting arm 151 includes a guiding surface 153. In the embodiment, as shown in FIG. 2, the connecting arm 151 extends perpendicularly and downward from the surface of the keycap 14. The engaging arm 152 is parallel to the surface of the keycap 14. The connecting rod 17 includes an operating arm 171 and an engaging portion 172. The operating arm 171 is connected to the engaging portion 172. In the embodiment, the engaging portion 172 is n-shaped to engage with the engaging arm 152, and thus the keycap 14 is restricted to move up and down via the engaging portion 172.

The connecting rod 17 is positioned via the substrate 11 to move along a direction parallel to the surface of the keycap 14. In an embodiment, a position limiting member protrudes from the substrate 11 and is connected to the operating arm 171. In such a way, the connecting rod 17 is connected to the substrate 11 via the position limiting member to limit the moving direction and the moving distance of the operating arm 171. In the embodiment, a button 18 is disposed at the operating arm 171 of the connecting rod 17 to facilitate the operation.

Please refer to FIG. 4, when the button 18 is operated to drive the operating arm 171 of the connecting rod 17 to move along the direction parallel to the surface of the keycap 14 (the direction indicated by the arrow in FIG. 4), the operating arm 171 drives the engaging portion 172 to move away from the bending portion 15 to disengage the engaging portion 172 from the engaging arm 152 of the bending portion 15. At the time, the elastic member 16 provides an upward force against the keycap 14 to move the keycap 14 away from the conduction switch 13. In such a way, it is convenient for a user to remove the keycap 14 for cleaning or replacing.

For assemble the keycap 14, the keycap 14 is aligned in position and pressed onto the conduction switch 13 and the elastic member 16. The button 18 is operated to drive the operating arm 171 of the connecting rod 17 to move along the direction parallel to the surface of the keycap 14. The moving direction is opposite to the direction in disassembling the keycap 14. That is, the engaging portion 172 moves toward the bending portion 15 until the engaging portion 172 engages with the bending portion 152. Then, after the upward force against the keycap 14 is released, the keycap 14 is fixed via the engagement between the engaging portion 172 and the engaging arm 152. Then, the assembling of the keycap 14 is finished.

With the configuration, when the user wants to disassemble the keycap 14, the user only needs to operate the button 18 to drive the operating arm 171 to disengage the engaging portion 172 from the engaging arm 152 of the bending portion 15. At the time, due to the disengagement between the keycap 14 and the connecting rod 17, the compressed elastic member 16 provides a force to move the keycap 14 upward. The keycap 14 is reassembled by pressing the keycap 14 and moving the operating arm 171 to re-engage the engaging portion 172 of the connecting rod 17 with the engaging arm 152. During the disassembling, the keycap 14 can be easily disassembled by moving the connecting rod 17, without using large force or special tools. The keycap 14 can be reassembled by pressing the keycap 14 and moving the connecting rod 17.

In the embodiment, to facilitate an accurate alignment when the engaging portion 172 moves to engage with the engaging arm 152, a guiding surface 153 is configured to the end of the engaging arm 152. In such a way, when the engaging portion 172 moves toward the engaging arm 152, the engaging portion 172 is aligned with the engaging arm 152 to engage slidably with the engaging arm 152 via the guiding surface 153.

Figure 5:
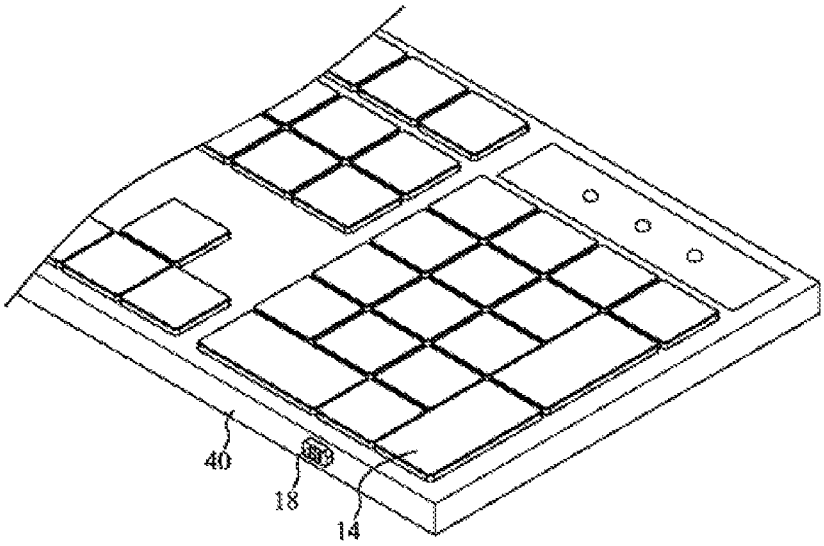
FIG. 5 is a schematic diagram showing a keyboard in a second embodiment.
Figure 6:
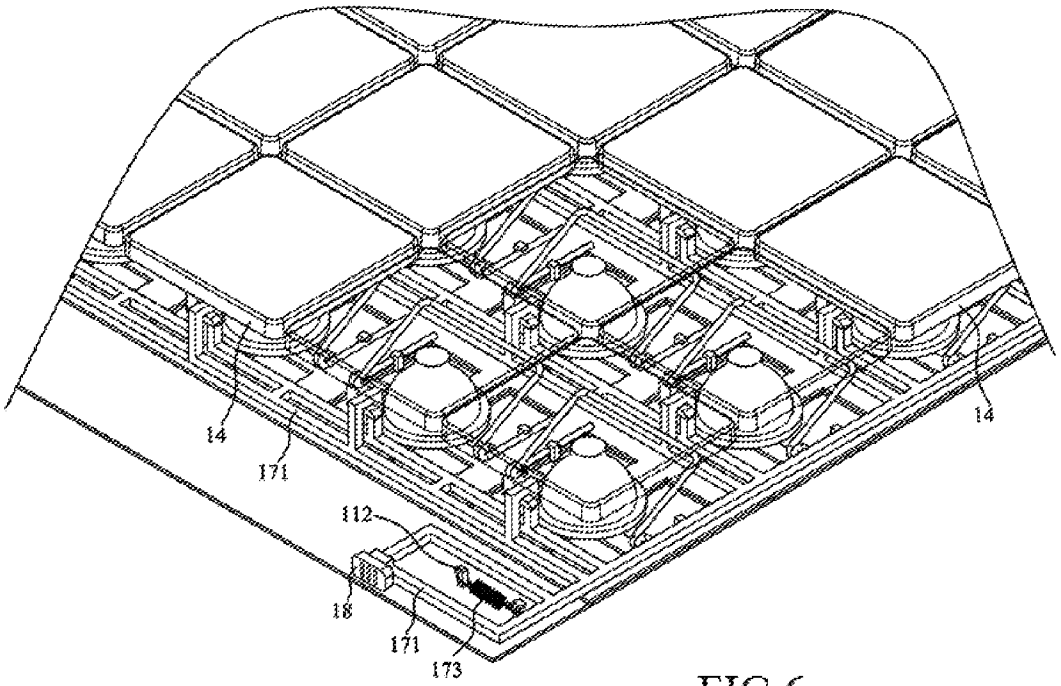
FIG. 6 is a perspective view of partial of the keyboard in the second embodiment.

Please refer to FIG. 5 and FIG. 6, FIG. 5 is a schematic diagram showing a keyboard in an embodiment, and FIG. 6 is a perspective view of partial of the keyboard in the second embodiment. In the embodiment, a keyboard is an external keyboard. In an embodiment, the keyboard is for a tablet computer, which is not limited herein. In the embodiment, the components are the same or similar to that in the first embodiment described above, and is denoted by the same or similar symbol, which is not repeatedly described. As shown in FIG. 5, the button 18 is disposed at a lateral surface of the case 40 of the keyboard for operation. In an embodiment, the button 18 is disposed at any side surface of the case 40 of the keyboard for easy operation, which is not limited herein.

Please refer to FIG. 6, when a plurality of key structures are mounted, all the connecting rods 17 are connected, the connecting rods 17 are driven simultaneously via one button 18. And all the keycaps 14 are disassembled at one time. It is more convenient, time-saving and energy-saving for the user to disassemble the keycaps 14 without removing the keycaps 14 one by one.

In the embodiment, the connecting rod 17 further includes an extension spring 173. The extension spring 173 is disposed close to the operating arm 171 which is connected to the button 18. An end of the extension spring 173 is connected to the operating arm 171, the other end of the extension spring 173 is fixed to the substrate 11. As shown in FIG. 6, a fixing hook 112 protrudes from the substrate 11, and an end of the extension spring 173 is hooked through the fixing hook 112. In an embodiment, the extension spring 173 is disposed close to any operating arm 171 inside the keyboard. In an embodiment, an end of the extension spring 173 is connected to the operating arm 171, and the other end of the extension spring 173 is fixed to the case 40, but not the substrate 11.

Figure 7:
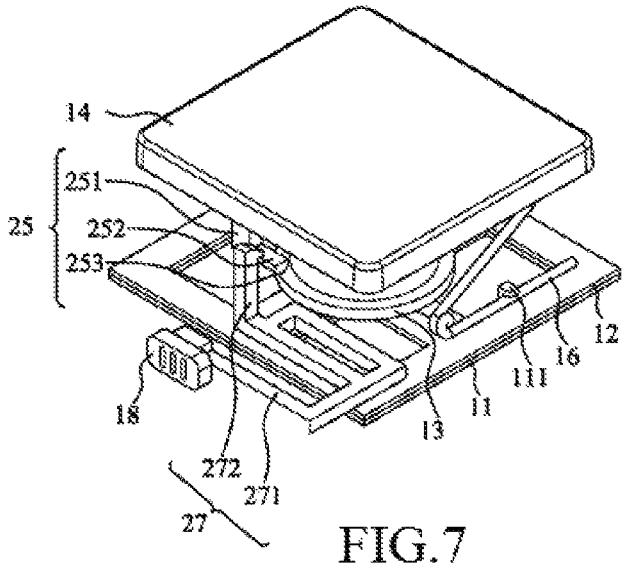
FIG. 7 is a schematic diagram showing a key structure in a third embodiment.
Figure 8:
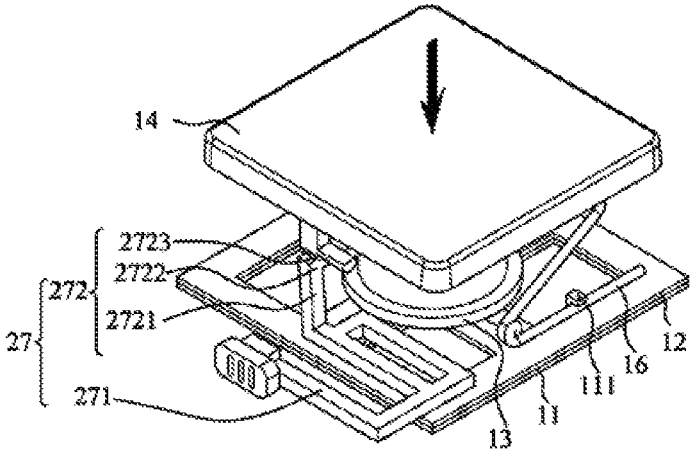
FIG. 8 is a schematic diagram showing the key structure in the third embodiment in assembling.

Please refer to FIG. 7 and FIG. 8, FIG. 7 is a schematic diagram showing a key structure in a third embodiment, and FIG. 8 is a schematic diagram showing the key structure in the third embodiment in assembling. In the embodiment, the components same or similar to that in the first embodiment are denoted by the same or similar symbol, which is not described herein. In the embodiment, the bending portion 25 includes a connecting arm 251 and an engaging arm 252. An end of the connecting arm 251 is connected to the keycap 14, and the other end is connected to the engaging arm 252. In the embodiment, the connecting arm 251 extends perpendicularly and downward from the surface of the keycap 14, and the engaging arm 252 is parallel to the surface of the keycap 14. The engaging arm 252 includes a guiding surface 253 at a side away from the keycap 14. As shown in FIG. 7, the guiding surface 253 is configured to the underside surface of the engaging arm 252.

As shown in FIG. 8, in the embodiment, the connecting rod 27 includes an operating arm 271 and an engaging portion 272. The engaging portion 272 includes an elastic arm 2721. A hook 2722 is disposed at an end of the elastic arm 2721. The hook 2722 includes an inclined surface 2723 at a side close to the keycap 14. Similar to the first embodiment, when the button 18 is operated to drive the operating arm 271 of the connecting rod 27 to move in the direction parallel to the surface of the keycap 14, the operating arm 271 drives the engaging portion 272 to move away from the bending portion 25 to disengage the engaging portion 272 from the engaging arm 252 of the bending portion 25. At the time, the elastic member 16 provides a force against the keycap 14 to move the keycap 14 away from the conduction switch 13 to facilitate the user to remove the keycap 14 for cleaning or replacing.

To reassemble the keycap 14, the keycap 14 is aligned in a right mounting position and pressed. At the time, the guiding surface 253 of the bending portion 25 pushes the inclined surface 2723 of the engaging portion 272 to move the elastic arm 2721 of the engaging portion 272 outwards, until the hook portion of the hook 2722 rebounds to engage with the engaging arm 252. Then, the keycap 14 is assembled.

Figure 9:
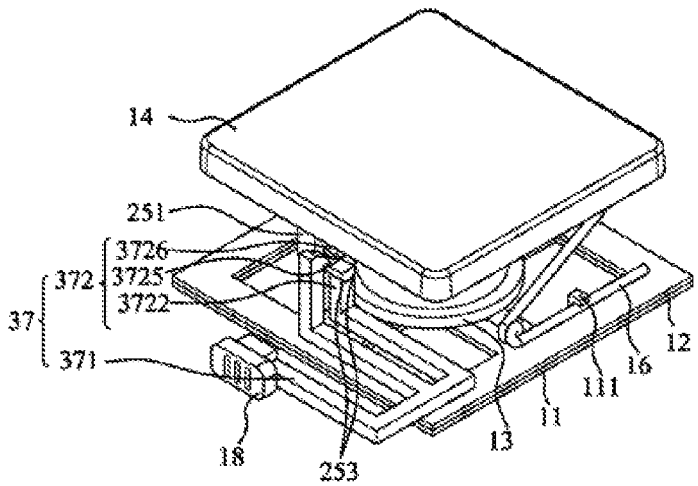
FIG. 9 is a schematic diagram showing a key structure in a fourth embodiment.
Figure 10:
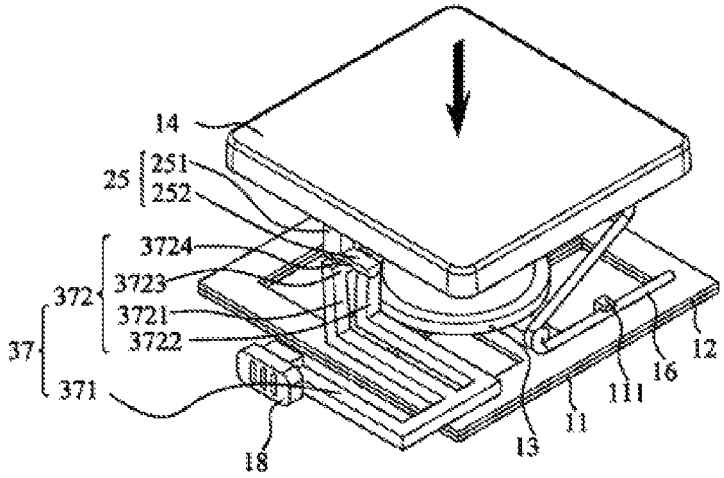
FIG. 10 is a schematic diagram showing the key structure in the fourth embodiment in assembling.

Please refer to FIG. 9 and FIG. 10. FIG. 9 is a schematic diagram showing a key structure in a fourth embodiment. FIG. 10 is a schematic diagram showing the key structure in the fourth embodiment in assembling. In the embodiment, the components the same or similar to that in FIG. 1 are denoted by the same or similar symbols, which is not described again herein. In the embodiment, a connecting rod 37 of a key structure is different from that in the third embodiment. In the embodiment, the connecting rod 37 includes an operating arm 371 and an engaging portion 372. The engaging portion 372 includes two elastic arms 3721, 3722 parallel to each other. An end of the elastic arm 3721 includes a hook 3723. The hook 3723 includes an inclined surface 3724 at a side close to the keycap 14. An end of the elastic arm 3722 includes a hook 3725. The hook 3725 includes an inclined surface 3726 at a side close to the keycap 14. In the embodiment, hook portions of the hooks 3723, 3725 at the ends of the two elastic arms 3721, 3722 face to each other. That is, the two hooks 3723, 3725 are combined in an n-shape to engage with the engaging arm 252 from the left and right sides of the engaging arm 252.

Similar to the first embodiment, when the button 18 is operated to drive the operating arm 371 of the connecting rod 37 to move in the direction parallel to the surface of the keycap 14, the operating arm 371 drives the engaging portion 372 to move away from the bending portion 25, and then the engaging portion 372 disengages from the engaging arm 252 of the bending portion 25. At the time, the elastic member 16 provides a force against the keycap 14 to move the keycap 14 away from the conduction switch 13 to facilitate the user to remove the keycap 14 for cleaning or replacing.

When the keycap 14 is reassembled, the keycap 14 is aligned with the right mounting position and pressed. At the time, the guiding surface 253 of the bending portion 25 pushes the inclined surfaces 3724, 3726 of the engaging portion 372 to moves the elastic arms 3721, 3722 of the engaging portion 372 outwards, until the hook portions of the hooks 3723, 3725 rebound to engage with the engaging arm 252. Then, the keycap 14 is assembled. In the embodiment, to make that the two inclined surfaces 3724, 3726 are pushed via the guiding surfaces 253 simultaneously, the guiding surfaces 253 are disposed at the two sides of the engaging arm 252 to push the corresponding inclined surfaces 3724, 3726, respectively.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A key structure, comprising:

a substrate;

a membrane circuit disposed on the substrate;

a conduction switch disposed on the membrane circuit;

a keycap;

a bending portion fixed to the keycap;

an elastic member disposed on the membrane circuit and abutting against the keycap; and a connecting rod movably disposed between the membrane circuit and the keycap, wherein the connecting rod includes an operating arm and an engaging portion, the operating arm is connected to the engaging portion, and the engaging portion selectively engages with the bending portion;

wherein when the operating arm moves in a direction parallel to a surface of the keycap, the operating arm drives the engaging portion to disengage from the bending portion, and the elastic member provides a force against the keycap to move the keycap away from the conduction switch.

2. The key structure according to claim 1, wherein the connecting rod further includes an extension spring, the extension spring connects the operating arm and the substrate.

3. The key structure according to claim 1, wherein the engaging portion is n-shaped, the bending portion includes a connecting arm and an engaging arm, the connecting arm connects the keycap and the engaging arm.

4. The key structure according to claim 3, wherein the engaging arm includes a guiding surface.

5. The key structure according to claim 1, wherein the engaging portion includes an elastic arm with a hook, the bending portion includes a connecting arm and an engaging arm, and the connecting arm connects the keycap and the engaging arm.

6. The key structure according to claim 5, wherein the connecting arm is particular to the surface of the keycap, the engaging arm is parallel to the surface of the keycap, and the engaging arm includes a guiding surface at a side away from the keycap.

7. The key structure according to claim 5, wherein the hook includes an inclined surface at a side close to the keycap.

8. The key structure according to claim 1, wherein the engaging portion includes two elastic arms parallel to each other, an end of each elastic arm includes a hook, the bending portion includes a connecting arm and an engaging arm, the connecting arm connects to the keycap and the engaging arm.

9. The key structure according to claim 8, wherein the connecting arm is perpendicular to the surface of the keycap, the engaging arm is parallel to the surface of the keycap, and the engaging arm includes a guiding surface at a side away from the keycap.

10. The key structure according to claim 8, wherein each hook includes an inclined surface at a side close to the keycap.

* * * * *